US010605545B2

(12) United States Patent
Meshenky

(10) Patent No.: US 10,605,545 B2
(45) Date of Patent: Mar. 31, 2020

(54) HEAT EXCHANGER AND CORE FOR A HEAT EXCHANGER

(71) Applicant: Modine Manufacturing Company, Racine, WI (US)

(72) Inventor: Steven Meshenky, Racine, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 0 days.

(21) Appl. No.: 16/075,883

(22) PCT Filed: Feb. 8, 2017

(86) PCT No.: PCT/US2017/016897

§ 371 (c)(1),
(2) Date: Aug. 6, 2018

(87) PCT Pub. No.: WO2017/139303

PCT Pub. Date: Aug. 17, 2017

(65) Prior Publication Data

US 2019/0049195 A1 Feb. 14, 2019

Related U.S. Application Data

(60) Provisional application No. 62/292,894, filed on Feb. 9, 2016.

(51) Int. Cl.
*F28F 9/00* (2006.01)
*F28F 9/007* (2006.01)
(Continued)

(52) U.S. Cl.
CPC ..... *F28F 9/001* (2013.01); *F02B 39/005* (2013.01); *F28D 1/0341* (2013.01);
(Continued)

(58) Field of Classification Search
CPC .... F28F 9/001; F28F 9/0075; F28F 2009/029; F28F 2280/06; F28D 1/0341; F28D 1/06; F28D 2021/0082
See application file for complete search history.

(56) References Cited

U.S. PATENT DOCUMENTS 3,635,283 A * 1/1972 Satchwell ..... F28D 1/0341 165/296
4,303,052 A * 12/1981 Manfredo ..... F01P 3/18 123/563

(Continued)

FOREIGN PATENT DOCUMENTS

DE 102013002478 A1 * 8/2014 ..... F28F 9/0132
JP 9217992 A2 8/1997

(Continued)

OTHER PUBLICATIONS

U.S. Appl. No. 61/985,588,Specification,filed Apr. 29, 2014 (Year: 2015).*

(Continued)

*Primary Examiner* — Devon Russell
(74) *Attorney, Agent, or Firm* — Michael Best & Friedrich LLP; Jeroen Valensa; Michael Bergnach

(57) ABSTRACT

A heat exchanger includes a heat exchanger core having two core sections, each core section having coolant flow passages. A mounting bracket is arranged between the core sections, being joined to each core section. A housing for the heat exchanger core includes multiple housing sections joined together to define an air flow path. The mounting bracket is secured between the multiple housing sections.

18 Claims, 4 Drawing Sheets

(51) Int. Cl.

| | |
|---|---|
| ***F28D 1/03*** | (2006.01) |
| ***F02B 39/00*** | (2006.01) |
| *F28D 21/00* | (2006.01) |
| *F28F 9/02* | (2006.01) |

(52) U.S. Cl.
CPC .... *F28F 9/0075* (2013.01); *F28D 2021/0082* (2013.01); *F28F 2009/029* (2013.01)

(56) References Cited

U.S. PATENT DOCUMENTS

| | | | | |
|---|---|---|---|---|
| 4,815,532 | A * | 3/1989 | Sasaki | F28D 1/0333 165/152 |
| 5,325,915 | A * | 7/1994 | Fouts | F28D 1/0325 165/144 |
| 5,791,402 | A | 8/1998 | Dumetz | |
| 5,964,282 | A * | 10/1999 | Seiler | F28D 1/0333 165/140 |
| 6,032,727 | A * | 3/2000 | Martins | F04D 29/601 123/41.49 |
| 7,051,789 | B2 * | 5/2006 | Sheppard | F28D 1/0333 165/149 |
| 7,302,997 | B2 * | 12/2007 | Kozdras | F28D 1/0333 165/153 |
| 7,320,358 | B2 * | 1/2008 | Kaspar | F28F 9/002 165/166 |
| 7,854,256 | B2 * | 12/2010 | Pineo | F01M 5/00 165/101 |
| 8,016,025 | B2 * | 9/2011 | Brost | F02B 29/0462 165/149 |
| 9,429,367 | B2 * | 8/2016 | Jouanny | F28D 9/005 |
| 9,557,749 | B2 * | 1/2017 | Sheppard | G05D 23/1852 |
| 2003/0121649 | A1 * | 7/2003 | Seiler | B21D 53/085 165/167 |
| 2003/0159805 | A1 * | 8/2003 | Muhammad | B21D 53/085 165/76 |
| 2006/0278377 | A1 | 12/2006 | Martins et al. | |
| 2008/0152983 | A1 * | 6/2008 | Horiuchi | H01M 8/0232 429/465 |
| 2008/0283700 | A1 * | 11/2008 | Vanderwees | F24D 19/0087 248/205.3 |
| 2012/0255709 | A1 * | 10/2012 | Kinder | F28F 9/002 165/67 |
| 2013/0045411 | A1 * | 2/2013 | Bauer | F28F 3/025 429/120 |
| 2015/0273808 | A1 * | 10/2015 | Thompson | B32B 37/182 156/272.8 |
| 2016/0097596 | A1 * | 4/2016 | Stewart | F28D 1/0233 165/175 |
| 2016/0195341 | A1 * | 7/2016 | Kominami | F24H 1/009 165/293 |

FOREIGN PATENT DOCUMENTS

| | | | | |
|---|---|---|---|---|
| KR | 101057847 | B1 * | 8/2011 | F01N 3/02 |
| WO | 2015091213 | A1 | 6/2015 | |

OTHER PUBLICATIONS

Notification of First Office Action for Chinese Application No. 201780010450.0, China National Intellectual Property Office, dated Nov. 28, 2019 (13 pages).

* cited by examiner

HEAT EXCHANGER AND CORE FOR A HEAT EXCHANGER

CROSS-REFERENCE TO RELATED APPLICATIONS

This application claims priority to U.S. Provisional Patent Application No. 62/292,894, filed on 9 Feb. 2016, the entire contents of which are hereby incorporated herein by reference.

BACKGROUND

Charge air coolers are used in conjunction with turbocharged internal combustion engine systems. In such systems, residual energy from the combustion exhaust is recaptured through an exhaust expansion turbine, and the recaptured energy is used to compress or "boost" the pressure of the incoming air (referred to as the "charge air") being supplied to the engine. This raises the operating pressure of the engine, thereby increasing the thermal efficiency and providing greater fuel economy.

The compression of the charge air using the exhaust gases typically leads to a substantial increase in temperature of the air. Such a temperature increase can be undesirable for at least two reasons. First, the density of the air is inversely related to its temperature, so that the amount of air mass entering the combustion cylinders in each combustion cycle is lower when the air temperature is elevated, leading to reduced engine output. Second, the production of undesirable and/or harmful emissions, such as oxides of nitrogen, increases as the combustion temperature increases. The emissions levels for internal combustion engines is heavily regulated, often making it necessary to control the temperature of the air entering the combustion chambers to a temperature that is relatively close to the ambient air temperature. As a result, cooling of the charge air using charge air coolers has become commonplace for turbocharged engines.

In some applications, the charge air is cooled using a liquid coolant (for example, engine coolant). A charge air cooler that uses liquid coolant to cool the charge air can be mounted directly to the engine, and in some cases can be located directly within the air intake manifold of the engine. Such an arrangement typically requires a metal heat exchange core that is mounted within an air handling enclosure. The securing of the heat exchange core within the enclosure can cause challenges. In some cases, such as shown in U.S. Pat. No. 8,016,025 to Brost et al., the entire core is inserted through a large opening of the enclosure and a top plate of the core seals the opening. Properly sealing such a large opening can be problematic, however, and there is still room for improvement.

SUMMARY

According to an embodiment of the invention, a core for a heat exchanger includes a first plurality of plate pairs arranged to form a first stack section, a second plurality of plate pairs arranged to form a second stack section, and a mounting bracket arranged between the first stack section and the second stack section. Coolant flow passages extend through each plate pair in the first and the second pluralities of plate pairs. Air flow passages extend between adjacent plate pairs. The mounting bracket includes a first face joined to a terminal end of the first stack section, and a second face opposite the first face joined to a terminal end of the second stack section.

In some embodiments, the first stack section extends over a first height dimension in a stacking direction. The second stack section extends over a second height dimension in a stacking direction, and the first height dimension is greater than the second height dimension. In some embodiments the ratio of the first height dimension to the second height dimension is not greater than four.

In some embodiments, first and second fluid manifolds extend through the first stack section. The coolant flow passages of the first plurality of plate pairs provide a fluid connection between the first and second fluid manifolds. Third and fourth fluid manifolds extend through the second stack section. The coolant flow passages of the second plurality of plate pairs provide a fluid connection between the third and fourth fluid manifolds. In some embodiments the first and third fluid manifolds are in alignment with each other, and in some of those embodiments the first and third fluid manifolds are in direct fluid communication with one another through the mounting bracket. In some embodiments the second and fourth fluid manifolds are in alignment with each other, and in some of those embodiments the second and fourth fluid manifolds are in direct fluid communication with one another through the mounting bracket.

In some embodiments, the coolant flow passages extending through the first plurality of plate pairs are fluidly in parallel with the coolant flow passages extending through the second plurality of plate pairs.

In some embodiments, each of the plate pairs includes a first formed plate joined to a second formed plate. The first stack section further includes another one of the first formed plates joined to the first face of the mounting bracket. The second stack section includes another one of the second formed plates joined to the second face of the mounting bracket. In some such embodiments, first and second fluid manifolds extend through the first stack section, the mounting bracket, and the second stack section. Coolant flow passages of the plate pairs provide a fluid connection between the fluid manifolds. Additional coolant flow passages are arranged between the mounting bracket and the formed plates joined to the mounting bracket, and provide additional fluid connection between the manifolds.

According to another embodiment of the invention, a heat exchanger for transferring heat between a flow of air and a coolant includes a first and a second housing section joined together to define an air flow path through the heat exchanger. A first heat exchange core section is received within the first housing section, and provides a first plurality of coolant flow passages. A second heat exchange core section is received within the second housing section, and provides a second plurality of coolant flow passages. A mounting plate is arranged between and joined to the first and second heat exchange core sections. A portion of the mounting plate is secured between the first and second housing sections.

In some embodiments, the first and second heat exchange sections and the mounting plate are part of a monolithic brazed structure. In some embodiments, the mounting plate is a flat plate.

In some embodiments, the first and second housing sections are formed of a plastic material. In some such embodiments the housing sections are joined by way of a welding process. In some embodiments at least some of the welds formed in the welding process extend through the mounting plate.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
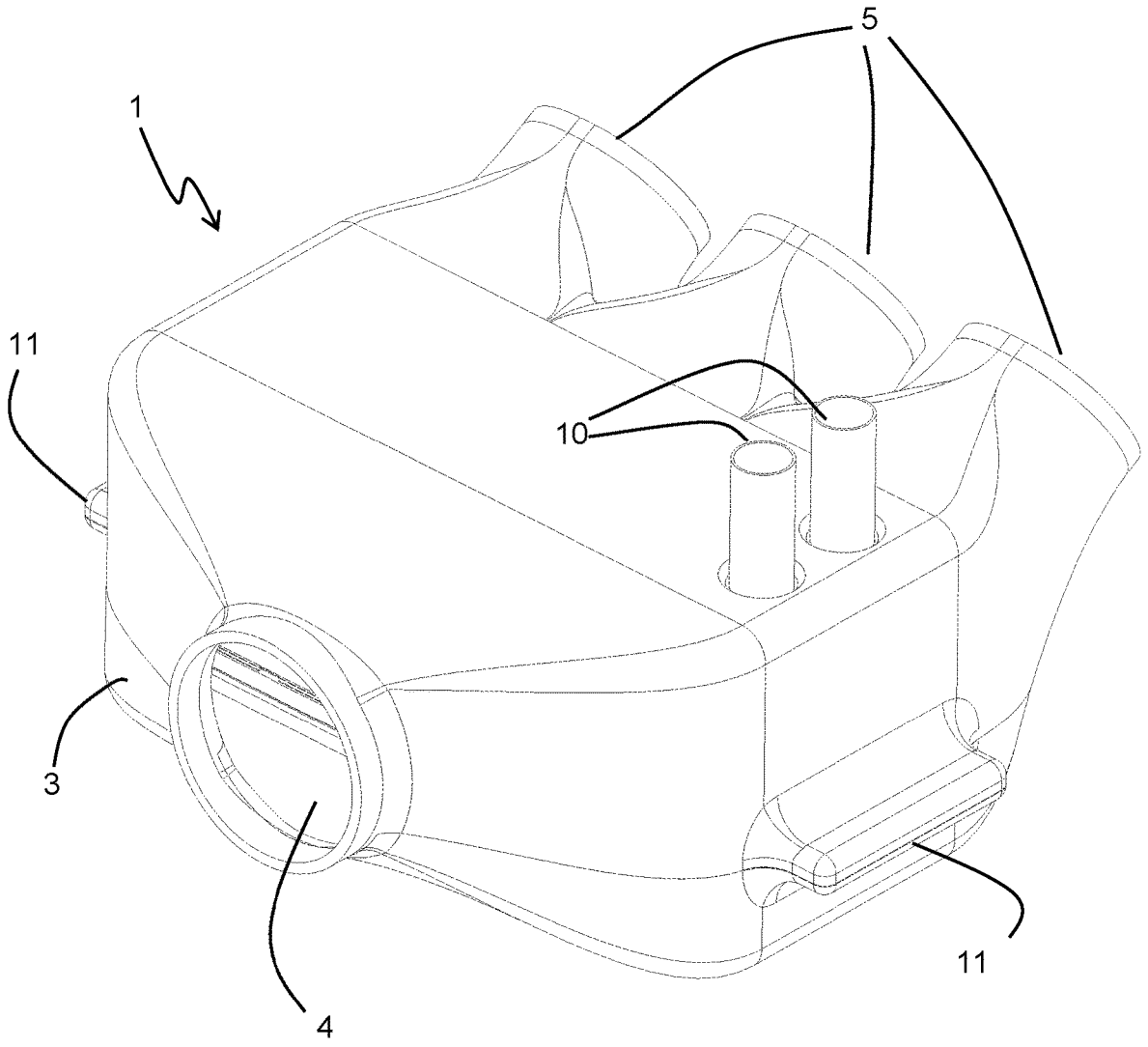
FIG. 1 is a perspective view of a heat exchanger according to an embodiment of the invention.
Figure 2:
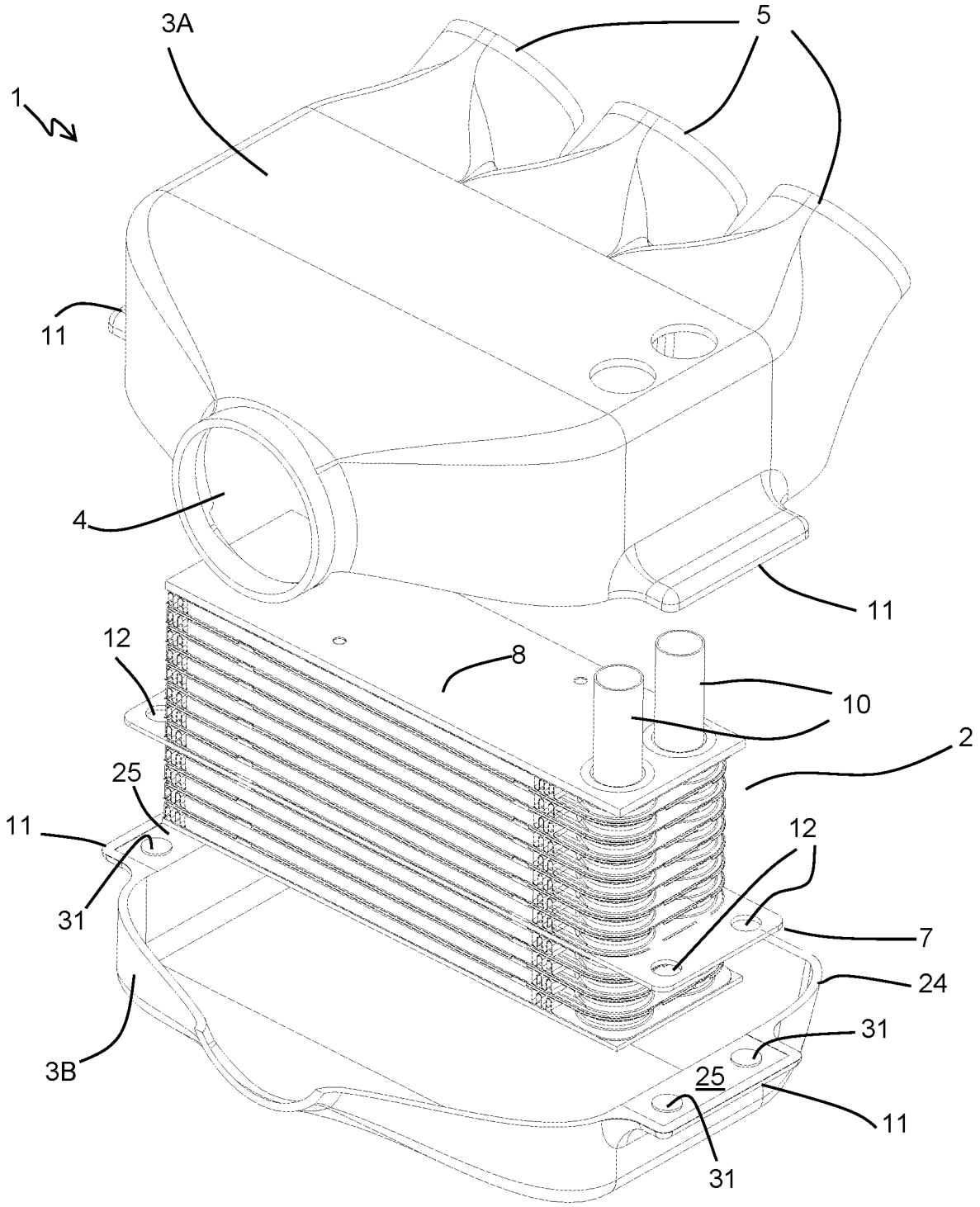
FIG. 2 is a partially exploded perspective view of the heat exchanger of FIG. 1.

FIGS. 1 and 2 depict a heat exchanger 1 according to an embodiment of the present invention. Such a heat exchanger 1 can find particular utility as a charge air cooler within a combustion engine system, for use (by way of example only) in vehicles such as automobiles. In such applications, a flow of compressed air (commonly referred to as "charge air") is reduced in temperature prior to being delivered to the combustion chambers of the engine in order to reduce the concentration of environmentally harmful pollutants present in the engine exhaust.

The heat exchanger 1 includes a housing 3. In some especially favorable embodiments, such as the exemplary embodiment depicted in FIGS. 1 and 2, the housing 3 can additionally serve as a portion of the air intake manifold of the engine, distributing the flow of compressed air to the various individual combustion chambers. Compressed air is received into the heat exchanger 1 through an inlet 4 that is fluidly coupled to a compressor such as, for example, a turbocharger. The turbocharger recovers otherwise wasted energy from the engine exhaust stream, using that energy to compress the incoming combustion air. The higher density of the compressed air increases the power output of the combustion process, thereby improving the overall energy efficiency of the engine. The energy efficiency can be further improved by cooling the compressed air, which typically experiences a substantial increase in temperature as it is compressed.

The housing 3 of the heat exchanger 1 further includes several air outlets 5 arranged downstream of the heat transfer section of the heat exchanger 1. In the exemplary embodiment, three such outlets 5 are provided. However, it should be understood that the number of such outlets can be varied depending on the needs of the application. In some applications, more outlets 5 may be desirable, while in other applications a single outlet 5 or a pair of outlets 5 may be equally or more desirable. In the case where the heat exchanger 3 serves as a portion of an air intake manifold for an engine, the number of air outlets 5 can be matched to a number of combustion cylinders of the engine, so that each of the air outlets 5 directs a portion of the overall flow of air to an equivalent number of combustion cylinders. In this manner, the heat exchanger can simultaneously cool the compressed charge air and distribute it generally equally among the combustion cylinders.

A heat exchange core 2 is provided within the housing 3 to transfer heat between the flow of compressed air passing through the heat exchanger 1 and a coolant. The coolant is typically a liquid coolant such as, for example, a mixture of ethylene glycol and water. In some instances an alternative type of coolant can be used, for example a refrigerant. The heat exchange core is constructed to provide a generally sealed coolant flow path and a generally open air flow path, so that air passing between the inlet 4 and the outlet(s) 5 passes over heat exchange surfaces of the core 2.

The heat exchange core 2 of the exemplary embodiment, shown in FIGS. 2-5, is constructed as a monolithic brazed structure. In some especially preferable embodiments, the components of the heat exchange core 2 are of an aluminum alloy construction, providing a lightweight and readily brazeable design. Flow passages for the coolant are provided within plate pairs 13, which are provided in an alternating stack arrangement with convoluted air fins 14. A single one of the plate pairs 13 is shown as an exploded assembly in FIG. 4. The plate pair 13 includes a first formed plate 15 and a second formed plate 16, which are sealingly joined at their perimeters. Recessed portions of the formed plates 15 and 16 cooperate to define a flow path for the coolant through the plate assembly 13, generally represented by the arrow 26. Inlet and outlet apertures 30 are provided in embossed areas 18 of the plates 15, 16 to allow for ingress and egress of the fluid into and out of the plate pair 13.

Inwardly facing formed features 23 provided on the plates 15, 16 maintain the requisite spacing to allow for flow of the coolant through the plate assembly 13, as well as establishing the routing of the coolant flow between those of the apertures 30 serving as the coolant inlet to the plate assembly 13 and those of the apertures 30 serving as the coolant outlets. The coolant can be directed to flow in a U-shaped path to provide two passes of the coolant through the plate pair 13, as shown in the exemplary embodiment. Alternatively, a single pass through the plate assembly can be achieved by arranging the inlet and outlet apertures 30 at opposing ends of the plates. In still other embodiments the formed features can be arranged to provide more than two passes of the coolant through the plate pair 13. The shape and placement of certain ones of the formed features 23 can also be optimized to achieve a desirable turbulation of the coolant flow in order to enhance the rate of heat transfer.

In the exemplary embodiment, the formed features 23 of the plate 15 correspond with those of the plate 16, so that the formed features of the two plates directly abut and join to one another. In other embodiments, it may be desirable for at least some of the formed features 23 to instead extend the full height of the coolant channel and directly engage the flat formed wall of the opposing plate. In any event, the plates 15 and 16 each provide an outwardly facing, generally planar wall 29 to which the convoluted fins 14 arranged between adjacent ones of the plate pairs 13 can be affixed. Formed tabs 27 and 28 can optionally be provided on one or both of the plates 15, 16 to assist in maintaining the relative positioning of the convoluted fins 14 between adjacent plate pairs 13 prior to the joining of the core 2 into a monolithic structure.

Figure 3:
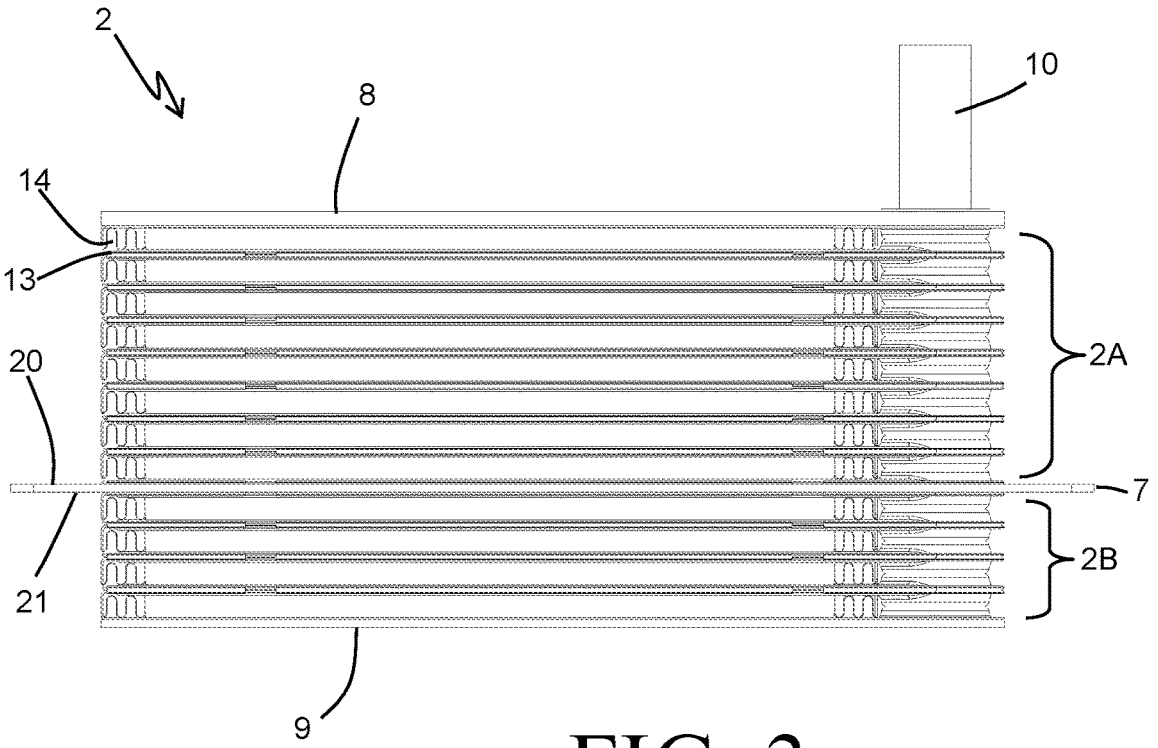
FIG. 3 is an elevation view of a core for a heat exchanger, according to another embodiment of the invention.
Figure 4:
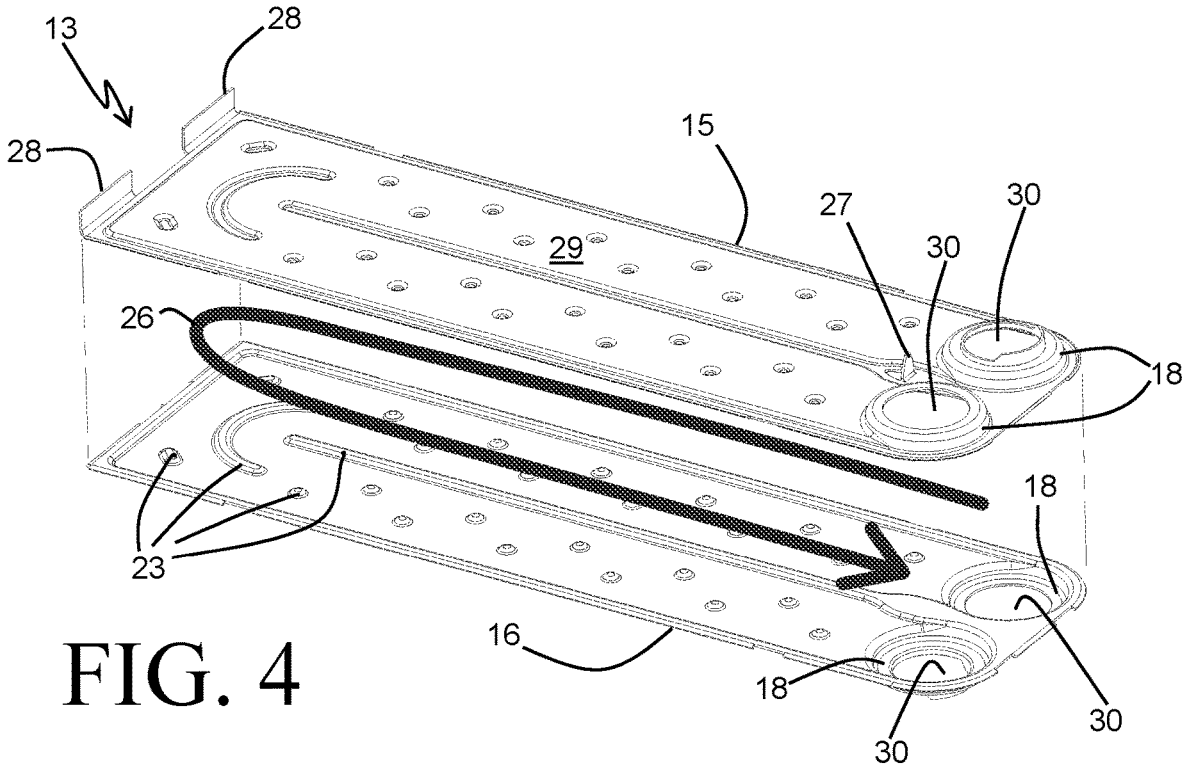
FIG. 4 is an exploded perspective view of a plate pair for use in the heat exchange core of FIG. 3.

Interposed within the stack of plate pairs and air fins is a mounting bracket 7, which serves to divide the heat exchange core 2 into two separate heat exchange sections 2A and 2B, arranged on either side of the mounting bracket 7. The mounting bracket 7 is constructed as a generally flat metal plate of such suitable thickness as to provide structural support for securing the heat exchange core 2 within the housing 3. As best seen in FIG. 3, the mounting bracket 7 extends past the stack of plate pairs and air fins on either side in a length-wise direction of the core 2. These extensions of the mounting bracket 7 allow for an engagement of the mounting bracket 7 with the housing 3 to secure the core 2 within the housing 3.

The mounting bracket 7 has a first planar surface 20 and a second planar surface 21 opposite the surface 20. The first heat exchange section 2A, which has a subset of the plate pairs 13 and convoluted fins 14, is provided as a stack that is joined at one terminal end to the planar surface 20. Similarly, the second heat exchange section 2B having another subset of the plate pairs 13 and convoluted fins 14 is provided as a stack that is joined at one terminal end to the planar surface 20.

As best seen in the exploded assembly view of FIG. 2, the housing 3 can be constructed of a first housing section 3A and a second housing section 3B. The first and second housing sections 3A, 3B are joined at a mating surface 24, which can be (but need not necessarily be) a planar surface. In some especially preferable embodiments the housing sections 3A and 3B are molded plastic components, allowing for a light-weight housing that can be constructed with the necessary features for mounting of the core and airflow management integrated therein. In such an embodiment, the housing sections 3A, 3B can be joined at the mating surface 24 by any variety of joining techniques, including gluing, ultrasonic welding, vibration welding, mechanical fasteners, and the like. In other embodiments, the housing sections 3A, 3B can be constructed of different materials, such as, for example, cast aluminum, which can be similarly joined. In the exemplary embodiment, the core section 2A is received within the housing section 3A, and the core section 2B is received within the housing section 3B.

The two heat exchange sections 2A and 2B can include a different number of repeating layers of plate pairs 13 and convoluted air fins 14. In the exemplary embodiment, the first heat exchange section 2A has seven of the plate pairs 13, whereas the second heat exchange section 2B has only three such plate pairs 13. As a result, the height of the core section 2A can be different than the height of the core section 2B. The relative heights of the two core sections can be selected, through the placement of the mounting bracket 7, to locate the mating surface 24 of the two housing sections 3A, 3B in a desirable location. It can be especially desirable to locate the mounting bracket 7 somewhat near the middle of the heat exchange core 2, so that the height of the core section 2A in the stacking direction is no more than four times the height of the core section 2B in the stacking direction, or vice-versa.

The housing sections 3A, 3B are preferably constructed with inner wall surfaces that conform closely to the extents of the stack of plate pairs and air fins in the aforementioned length-wise direction of the heat exchange core 2. In this manner, the undesirable bypass of air around the heat exchange core, and the resultant delivery of uncooled air from the heat exchanger 1, can be avoided or minimized. Extensions 11 are provided at sides of the housing sections 3A, 3B to accommodate the extensions of the mounting bracket 7. The extensions 11 are provided with planar seating surfaces 25 that abut the surfaces 20 and 21 of the mounting bracket 7 when the housing sections 3A and 3B are joined together. Openings 12 can optionally be provided in the mounting bracket 7, and corresponding bosses 31 can be provided on the seating surfaces 25 of one or both of the housing sections to provide for precise alignment and retention of the heat exchange core 2 within the housing 3. Joints (by ultrasonic welding, for example) can be created between the housing sections within each of the openings 12 in order to further secure the core 2 by having at least some of the welds extending through the mounting bracket 7.

Figure 5:
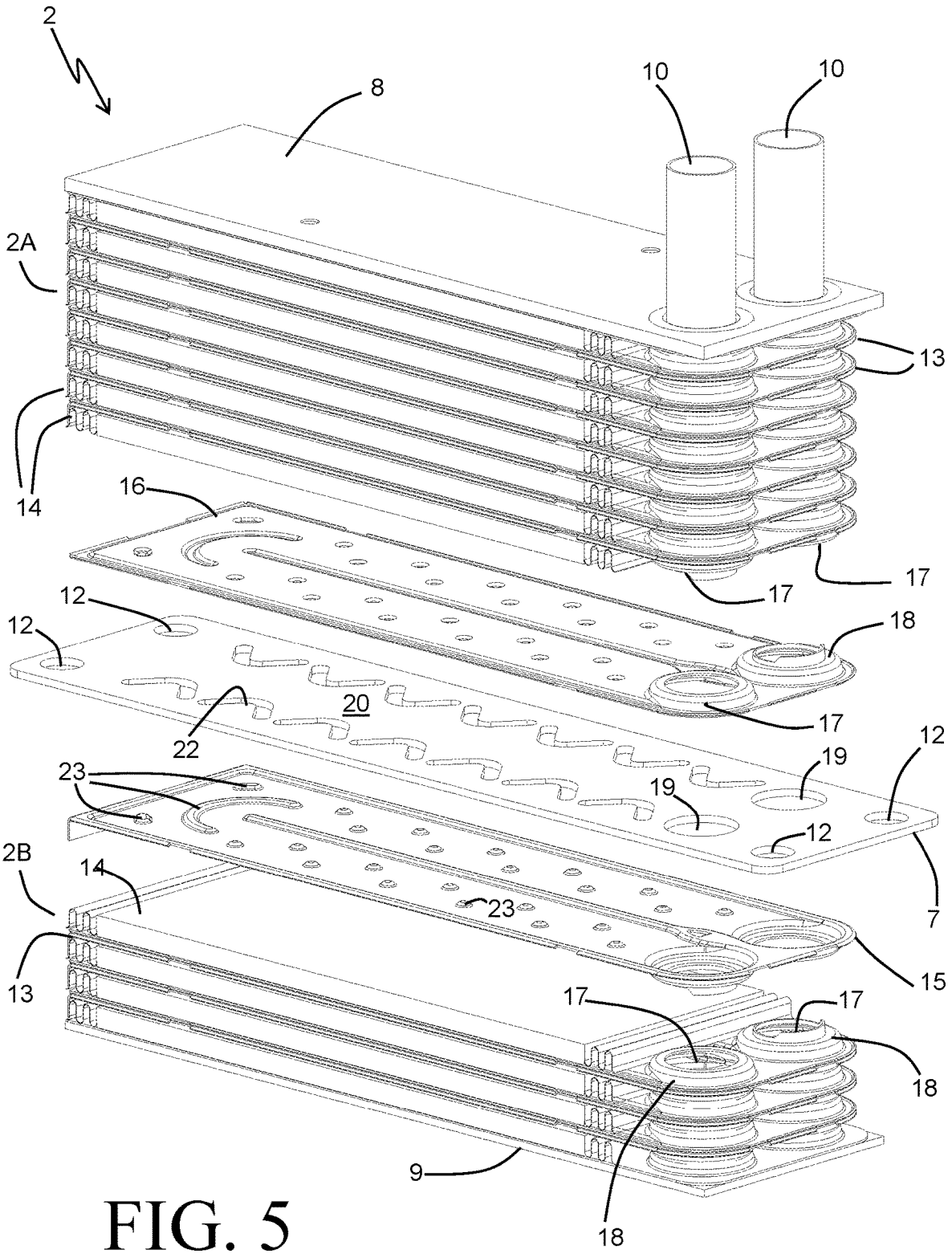
FIG. 5 is a partially exploded perspective view of the heat exchange core of FIG. 3.

The embossed features 18 of adjacent one of the plate pairs 13 in each of the core sections 2A and 2B joint together to create coolant manifolds 17, as best seen in the partially exploded view of FIG. 5. Each of the coolant flow paths extending through a plate pair 13 are thereby fluidly connected to the manifolds 17 so that coolant can be received into the plate pairs from one of the fluid manifolds 17 and can be returned to the other fluid manifold 17 after having passed through the plate pairs 13 and received heat from the heated air passing through the convoluted fins 14. Apertures 19 are provided in the mounting bracket 7 and generally correspond to the apertures 30 to allow the coolant manifolds 17 to extend the full height of the heat exchange core 2. In this manner, the coolant flow paths through the heat exchange section 2A are placed fluidly in parallel with the coolant flow paths extending through the heat exchange section 2B.

In order to ensure adequate cooling of the air passing through those ones of the convoluted fins 14 closes to the mounting bracket 7, it can be desirable to also provide a coolant flow path directly at the location of the mounting bracket 7. In the exemplary embodiment, as shown in FIG. 5, this is accomplished by providing an additional formed plate 16 at the terminal end of the core section 2A directly joined to the surface 20 of the mounting bracket 7, and by providing an additional formed plate 15 at the terminal end of the core section 2B directly joined to the surface 21 of the mounting bracket 7. Two half-height coolant channels are thereby provided, one on either side of the mounting bracket 7. The formed features 23 of each of those two plates 15, 16 can directly abut and be joined to the formed plate 7 in order to provide spacing for the coolant. In addition, apertures 22 can be provided through the mounting bracket 7 to allow for communication between the coolant on either side of the mounting bracket 7. Such communication channels can ensure better distribution of the coolant. The shapes of the apertures 22 can be selected to optimize the coolant communication while still providing attachment surfaces for the formed features 23 and maintaining the structural integrity of the mounting bracket 7.

Opposing ends of the heat exchange core 2 are capped with a top plate 8 at one end and a bottom plate 9 at the other end. Coolant ports 10 are provided at the end capped with the top plate 8, and fluidly connect to the coolant manifolds 17. The coolant ports 10 extend through corresponding openings 24 in the housing 3 to allow for fluid connection to a coolant system. The undesirable leakage of air through the openings 24 can be prevented by the use of O-rings or other known sealing solutions.

While the coolant ports 10 are shown extending from one end of the heat exchange core 2, in some alternative embodiments the ports may be arranged at opposing ends. Such an alternative arrangement can be especially beneficial if it is desirable for the coolant flow paths of one of the core sections to be arranged fluidly in series with those of the other core section. Such a flow arrangement can be achieved by removing that one of the apertures 19 corresponding with the coolant port 10 that operates as the inlet port. Flow received into the heat exchange core will be distributed to only those coolant flow paths that are provided in that one of the two core sections on the same side of the mounting bracket 7 as the inlet port 10. After having passed through those plate pairs, the flow of coolant is collected in the opposing manifold 17, which extends through the aperture 19 of the mounting plate. The coolant con thus be directed into the plate pairs of the other heat exchange section from that manifold 17, and can be removed from the core 2 by an outlet port 10 connected to the other manifold 17.

In still other embodiments, the apertures 19 can be eliminated entirely so that the coolant flow paths extending through the core section 2A are completely separated from the coolant flow paths extending through the core section 2B. Such an embodiment allows for the use of two different coolants to which the heat from the compressed air can be rejected. Coolant ports 10 can be provided at each end of the heat exchange core 2 to provide for separate inlet and outlet of each coolant to and from the core 2.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

I claim:

1. A heat exchanger comprising:

a housing defining an air flow path, the housing having a first housing section and a second housing section, each of the first housing section and the second housing section having a mating surface and a seating surface, wherein the mating surface of the first housing section is joined to the mating surface of the second housing section; and a heat exchange core located within the housing, the heat exchange core including, a first plurality of plate pairs stacked in a stacking direction to form a first stack section, coolant flow passages extending through each plate pair in the first plurality of plate pairs and air flow passages extending between adjacent plate pairs in the first plurality of plate pairs;

a second plurality of plate pairs stacked in the stacking direction to form a second stack section, coolant flow passages extending through each plate pair in the second plurality of plate pairs and air flow passages extending between adjacent plate pairs in the second plurality of plate pairs;

a mounting bracket arranged between the first stack section and the second stack section in the stacking direction, the mounting bracket including a first face joined to a terminal end of the first stack section and abutting the seating surface of the first housing section and a second face opposite the first face joined to a terminal end of the second stack section and abutting the seating surface of the second section;

first and second fluid manifolds extending through the first stack section, the coolant flow passages of the first plurality of plate pairs providing a fluid connection between the first and second fluid manifolds; and third and fourth fluid manifolds extending through the second stack section, the coolant flow passages of the second plurality of plate pairs providing a fluid connection between the third and fourth fluid manifolds.

2. The heat exchanger of claim 1, wherein the first stack section extends over a first height dimension in the stacking direction and the second stack section extends over a second height dimension in the stacking direction, the first height dimension being greater than the second height dimension.

3. The heat exchanger of claim 2, wherein the ratio of the first height dimension to the second height dimension is not greater than four.

4. The heat exchanger of claim 1, wherein the first and third fluid manifolds are in alignment, wherein the second and fourth fluid manifolds are in alignment, wherein the first and third fluid manifolds are in direct fluid communication with one another through the mounting bracket, and wherein the second and fourth fluid manifolds are in direct fluid communication with one another through the mounting bracket.

5. The heat exchanger of claim 1, wherein the mounting bracket comprises a flat plate.

6. The heat exchanger of claim 1, wherein the coolant flow passages extending through each plate pair in the first plurality of plate pairs are parallel to the coolant flow passages extending through each plate pair in the second plurality of plate pairs.

7. The heat exchanger of claim 1, wherein each of the first and second pluralities of plate pairs includes one of a plurality of first formed plates joined to one of a plurality of second formed plates, the first stack section comprising another one of the plurality of first formed plates not belonging to a plate pair joined to the first face of the mounting bracket and the second stack section comprising another one of the plurality of second formed plates not belonging to a plate pair joined to the second face of the mounting bracket.

8. The heat exchanger of claim 1, wherein the mounting bracket is sandwiched between the first housing section and the second housing section at least at a first location.

9. The heat exchanger of claim 1, wherein the first stack section is at least partially disposed within the first housing section and wherein the second stack section is at least partially disposed within the second housing section.

10. The heat exchanger of claim 1, wherein the first housing section includes a first extension extending from a first side of the housing, wherein the second housing section includes a second extension extending from the first side of the housing, and wherein the mounting bracket extends in a length-wise direction of the core past a core side and along both the first extension and the second extension past the first side of the housing.

11. The heat exchanger of claim 10, wherein the first housing section includes a third extension extending from a second side of the housing, wherein the second housing section includes a fourth extension extending from the second side of the housing, and wherein the mounting bracket extends in a length-wise direction of the core past another core side located proximal to the second side of the housing and extends along both the third extension and the fourth extension past the second side of the housing.

12. The heat exchanger of claim 10, wherein the mounting bracket includes at least one mounting hole and wherein the first extension and the second extension each have at least one boss the extends at least partially through the at least one mounting hole.

13. The heat exchanger of claim 1, wherein the first stack section includes a first formed plate at the terminal end of the first stack section, wherein the second stack section includes a second formed plate at the terminal end of the second stack section, wherein the first formed plate and the second formed plate each include formed features located with a formed cavity, and wherein the formed features of the first formed plate are joined to the first face of the mounting bracket and the formed features of the second formed plate are joined to the second face of the mounting bracket.

14. The heat exchanger of claim 13, wherein the mounting bracket includes a plurality of apertures that extend between a first cavity of the first formed plate and a second cavity of the second formed plate and wherein a least one of the formed features of each of the first formed plate and the second formed plate is located between two apertures of the mounting bracket.

15. A heat exchanger for transferring heat between a flow of air and a coolant, comprising:

a first and a second housing section joined together to define an air flow path through the heat exchanger;

a first heat exchange core section received within the first housing section, a first plurality of coolant flow passages extending through the first heat exchange core section between a first fluid manifold and a second fluid manifold;

a second heat exchange core section received within the second housing section, a second plurality of coolant flow passages extending through the second heat exchange core section between the first fluid manifold and the second fluid manifold; and a mounting bracket arranged between the first and second heat exchange core section and joined thereto, a portion of the mounting bracket being secured between the first and second housing sections, wherein the first and second fluid manifolds each extend through the first heat exchange core section, the second heat exchange core section, and the mounting bracket, wherein the first and second housing sections are joined by way of a welding process, and wherein at least some welds formed in the welding process extend through the mounting bracket.

16. The heat exchanger of claim 15, wherein the first heat exchange section, the second heat exchange section, and the mounting bracket are part of a monolithic brazed structure.

17. The heat exchanger of claim 16, wherein the first and second housing sections are formed of a plastic material.

18. The heat exchanger of claim 15, further comprising:

a first coolant port joined to one of the first and second heat exchange sections and fluidly connected to the first fluid manifold to deliver a flow of coolant thereto; and a second coolant port joined to one of the first and second heat exchange sections and fluidly connected to the second fluid manifold to receive a flow of coolant therefrom, wherein the first and second coolant ports each extend through one of the first and second housing sections.

* * * * *